US010678169B1

(12) United States Patent
Yoshida et al.

(10) Patent No.: US 10,678,169 B1
(45) Date of Patent: Jun. 9, 2020

(54) INTERMEDIATE TRANSFER BELT AND ELECTROPHOTOGRAPHIC IMAGE FORMING APPARATUS PROVIDED WITH SAME

(71) Applicant: Konica Minolta, Inc., Tokyo (JP)

(72) Inventors: Eiichi Yoshida, Hino (JP); Sadaaki Sakamoto, Hachioji (JP); Ito Koga, Hino (JP); Shiori Tsugawa, Hino (JP); Daisuke Ikeda, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/677,108

(22) Filed: Nov. 7, 2019

(30) Foreign Application Priority Data

Jan. 16, 2019 (JP) ..... 2019-004960

(51) Int. Cl.
*G03G 15/16* (2006.01)

(52) U.S. Cl.
CPC ..... *G03G 15/162* (2013.01)

(58) Field of Classification Search
CPC ..... G03G 15/162
See application file for complete search history.

(56) References Cited

U.S. PATENT DOCUMENTS

2010/0239764 A1* 9/2010 Ichizawa ..... B30B 5/04 427/336
2018/0173136 A1* 6/2018 Uchida ..... B29C 49/4273
2019/0265605 A1* 8/2019 Koga ..... G03G 15/08

FOREIGN PATENT DOCUMENTS

JP H08-152759 A 6/1996

* cited by examiner

*Primary Examiner* — Carla J Therrien
(74) *Attorney, Agent, or Firm* — Lucas & Mercanti, LLP

(57) ABSTRACT

Provided is an intermediate transfer belt for an electrophotographic image forming apparatus including conductor-coated particles in which ferroelectric particles are coated with a conductor.

8 Claims, 4 Drawing Sheets

INTERMEDIATE TRANSFER BELT AND ELECTROPHOTOGRAPHIC IMAGE FORMING APPARATUS PROVIDED WITH SAME

CROSS-REFERENCE TO RELATED APPLICATION

The entire disclosure of Japanese Patent Application No. 2019-004960, filed on Jan. 16, 2019 with Japan Patent Office, is incorporated herein by reference in its entirety.

BACKGROUND

1. Technological Field

The present invention relates to an intermediate transfer belt and an electrophotographic image forming apparatus provided with the same. More specifically, the present invention relates to an intermediate transfer belt excellent in transferability and durability and an electrophotographic image forming apparatus provided with the same intermediate transfer belt.

2. Description of the Related Art

Conventionally, as an electrophotographic image forming apparatus using an intermediate transfer belt, it is known that a toner image formed on a photoreceptor is primarily transferred to an intermediate transfer belt, and the toner image on the intermediate transfer belt is secondarily transferred to a transfer material such as transfer paper (recording paper). That is, a toner image formed on a photoreceptor and charged to a predetermined polarity is transferred to an intermediate transfer belt using electrostatic force, and then the toner image on the intermediate transfer belt is transferred using electrostatic force onto a transfer material.

An image forming apparatus using such an intermediate transfer belt sequentially superimposes toner images formed on the respective photoreceptors using electrostatic force on the intermediate transfer belt, and further the superimposed toner image can be collectively transferred to a transfer material. Therefore, it is widely used as a color image forming apparatus.

The intermediate transfer belt is required to have various performances such as transfer performance and cleaning performance. Among these, in order to improve transfer efficiency, a technique for dispersing a ferroelectric substance in an intermediate transfer belt has been proposed in the past (for example, refer to Patent Document 1: JP-A 8-152759). Generally, the intermediate transfer belt is adjusted in electrical resistance so that it becomes a semiconductive region with a carbon-based conductive material such as carbon black. However, when a ferroelectric substance is added to the resin constituting the intermediate transfer belt, since the ferroelectric substance has a high electric resistance, a high resistance portion and a low resistance portion are formed in the intermediate transfer belt. As a result, the transfer electric field is disturbed, causing transfer failure.

Furthermore, by adding a ferroelectric substance as a filler, the interface between the filler and the resin in the intermediate transfer belt increases, the frequency of breakage from the interface increases, and the intermediate transfer body breaks during use. Thus, the durability of the intermediate transfer belt was a problem.

SUMMARY

The present invention has been made in view of the above-described problems and situations, and an object of the present invention is to provide an intermediate transfer belt excellent in transferability and durability. Another object of the present invention is to provide an electrophotographic image forming apparatus having the same.

To achieve at least one of the above-mentioned objects according to the present invention, an intermediate transfer belt reflecting an aspect of the present invention comprises conductor-coated particles in which ferroelectric particles are coated with a conductor.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
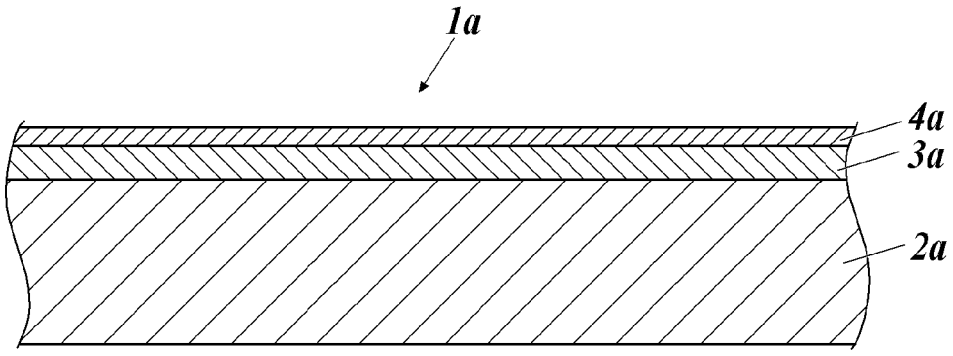
FIG. 1 is a conceptual sectional view indicating an example of a layer structure of the intermediate transfer belt of the present invention.

Hereinafter, one or more embodiments of the present invention will be described. However, the scope of the invention is not limited to the disclosed embodiments.

The intermediate transfer belt of the present invention contains conductor-coated particles obtained by coating ferroelectric particles with a conductor. This feature is a technical feature common to or corresponding to each of the following embodiments.

By the above embodiments of the present invention, an intermediate transfer belt excellent in transferability and durability may be provided. In addition, an electrophotographic image forming apparatus including the same may be provided.

The expression mechanism or action mechanism of the effect of the present invention is not clear, but is presumed as follows.

By coating the surface of the ferroelectric particles with a conductor, the uniformity of the resistance of the intermediate transfer belt is increased, and the disturbance of the transfer electric field due to the mixture of the high resistance portion derived from the ferroelectric substance and the low resistance portion due to the conductor may be suppressed. Therefore, it is assumed that transferability is improved. Further, the increase in the interface of the ferroelectric particles with the filler and the resin is also suppressed. It is presumed that damage from the interface is suppressed and durability is improved.

As an embodiment of the present invention, from the viewpoint of appropriately controlling the electric field strength acting on the toner, it is preferable that the relative permittivity at a frequency of 1 MHz is in the range of 10 to 60 in an environment of a temperature of 23° C. and a humidity of 50% RH. In the present invention, the ferroelectric particles preferably have an average particle diameter in the range of 100 to 900 nm and contain barium titanate or strontium titanate. Thereby, the transfer efficiency may be further improved. As an embodiment of the present invention, it is preferable that the conductor contains carbon black, nanocarbon, or graphite from the viewpoint of easy adjustment of electric resistance and easy coating of ferroelectric particles.

Further, in the present invention, the conductor preferably contains carbon black having an average primary particle diameter in the range of 10 to 50 nm. Thereby, the effect of improving the coverage of the ferroelectric particles may be obtained. As an embodiment of the present invention, from the viewpoint of improving conductivity, the conductor preferably contains carbon nanotubes having an average tube diameter of 10 to 150 nm. Further, the average coverage of the conductor with respect to the ferroelectric particles is more preferably in the range of 30 to 90% from the viewpoint of manifesting the effects of the present invention. The intermediate transfer belt of the present invention may be suitably provided in an electrophotographic image forming apparatus.

The present invention and the constitution elements thereof, as well as configurations and embodiments, will be detailed in the following. In the present description, when two figures are used to indicate a range of value before and after "to", these figures are included in the range as a lowest limit value and an upper limit value.

<<Intermediate Transfer Belt>>

The intermediate transfer belt of the present invention contains conductor-coated particles obtained by coating ferroelectric particles with a conductor. By adopting such a configuration, the uniformity of resistance of the intermediate transfer belt is increased, so that transferability is improved. Further, since the breakage of the ferroelectric particles from the interface between the filler and the resin is suppressed, it is considered that the durability is improved.

FIG. 1 is a conceptual sectional view indicating an example of a layer structure of the intermediate transfer belt of the present invention. In FIG. 1, la is an intermediate transfer belt, 2*a* is a base material layer, 3*a* is an elastic layer, and 4*a* is a surface layer. The intermediate transfer belt of the present invention may be composed of only the base material layer 2*a*. However, if necessary, the intermediate transfer belt may have a structure such as an elastic layer 3*a* or a surface layer 4*a* on the base material layer 2*a* in this order. The thickness of the intermediate transfer belt may be appropriately determined according to the purpose of use, but is preferably in the range of 50 to 100 μm. The thinner the thickness is, the lower the voltage required for transfer is, so that discharge is suppressed and transfer efficiency is improved. Therefore, the thickness is preferably not more than 100 μm. When the thickness is 50 μm or more, the strength of the intermediate transfer belt may be sufficiently maintained.

The intermediate transfer belt of the present invention preferably contains the conductor-coated particles coated with a conductor dispersed in the resin that forms the base material layer. The reason is that the electrostatic adhesion between the toner and the surface of the intermediate transfer belt does not increase compared to the case where the elastic layer or the surface layer contains conductor-coated particles. For this reason, the toner is not prevented from being transferred to a transfer medium such as paper. However, if necessary, the conductor-coated particles may be contained in the elastic layer or the surface layer. The relative permittivity of the intermediate transfer belt at a frequency of 1 MHz is preferably in the range of 10 to 60 in an environment of a temperature of 23° C. and a humidity of 50% RH. The relative permittivity of 10 or more is preferable because it is easy to increase the transfer electric field. On the other hand, when the relative permittivity is 60 or less, the adhesive force between the toner and the intermediate transfer belt is increased, and the transfer efficiency is not lowered. By adjusting the type and content of the ferroelectric substance used for the ferroelectric particles in the intermediate transfer belt, the relative permittivity may be adjusted to an appropriate value. By the intermediate transfer belt having the above thickness, the electric field strength acting on the toner may be controlled to an appropriate value.

The electric resistance value (volume resistivity) of the intermediate transfer belt is preferably in the range of $10^5$ to $10^{11}$ Ω·cm. The electrical resistance value may be controlled by the content of the conductor. The shape of the intermediate transfer belt is preferably an endless intermediate transfer belt, because there is no change in thickness due to superposition, and an arbitrary portion can be set as a belt rotation start position, and the control mechanism for the rotation start position can be omitted. Hereinafter, the configuration of the intermediate transfer belt of the present invention will be described.

<<Base Material Layer>>

The base material layer according to the present invention preferably contains conductor-coated particles coated with a conductor in a state dispersed in the resin.

[Resin]

Various types of resin may be used. Preferable resins are super engineering plastics having strength and durability such as polyimide (PI), polyamideimide (PAI), polyphenylene sulfide (PPS), and polyetheretherketone (PEEK).

Of these, polyimide, polyamide and polyamideimide are preferable. Among them, polyimide is more preferable since it is excellent in characteristics such as heat resistance, bending resistance, flexibility, and dimensional stability. Polyimide is obtained, for example, by synthesizing a polyamic acid (polyimide precursor) from an acid anhydride and a diamine compound, and imidizing the polyamic acid with heat or a catalyst.

The acid anhydride used for the synthesis of polyimide is not particularly limited. Examples thereof are aromatic tetracarboxylic dianhydrides such as: biphenyltetracarboxylic dianhydride, terphenyltetracarboxylic dianhydride, benzophenonetetracarboxylic dianhydride, pyromellitic anhydride, oxydiphthalic dianhydride, diphenylsulfone tetracarboxylic dianhydride, hexafluoroisopropylidene diphthalic acid dianhydride, and cyclobutanetetracarboxylic acid dianhydride.

The diamine compound used for the synthesis of polyimide is not particularly limited. Examples thereof are aromatic diamines such as: p-phenylenediamine, m-phenylenediamine, 2,4-diaminotoluene, 4,4'-diaminodiphenylmethane, 4,4'-diaminodiphenyl ether, 3,4'-diaminodiphenyl ether, 3,3'-dimethyl-4,4'-diaminobiphenyl, 2,2'-bis (trifluoromethyl)-4,4'-diaminobiphenyl, 3,7-diamino-dimethyldibenzothiophene-5,5'-dioxide, 4,4'-diaminobenzophenone, 4,4'-bis(4-aminophenyl) sulfide, 4,4'-diaminobenzanilide, and 1,4-bis(4-aminophenoxy)benzene.

[Conductor-Coated Particles]

An intermediate transfer belt of the present invention contains conductor-coated particles in which ferroelectric particles are coated with a conductor. The conductor-coated particles are preferably contained in the base material layer.

<<Ferroelectric Particles>>

The ferroelectric particles used in the present invention are ferroelectric fine particles. In the present invention, a ferroelectric substance is a kind of dielectric substance, and is a substance in which electric dipoles are aligned even if there is no electric field outside and the direction of the dipoles can be changed by the electric field. Specifically, in the present invention, a ferroelectric substance indicates a substance having a relative permittivity of 15 or more at a frequency of 1 MHz in an environment of a temperature of 23° C. and a humidity of 50% RH. Preferably, the relative permittivity is 20 or more, more preferably 100 or more. A higher dielectric constant is preferable from the viewpoint of the effects of the present invention. The upper limit is limited by material availability.

In addition, the state in which the electric dipole moments are spontaneously aligned in this manner is called a ferroelectric state, and this property is called ferroelectricity. Among the materials having ferroelectricity, in the present invention, ferroelectric ceramics are desirable as the ferroelectric particles because of the load in the production process and the stability when used over time. Examples of the ferroelectric ceramic include barium titanate, calcium titanate, strontium titanate, magnesium titanate, and calcium zirconate. Further, solid solutions of these substances may be used as the ferroelectric particles. Of these, barium titanate or strontium titanate is more preferable.

The average particle diameter of the ferroelectric particles is preferably in the range of 100 to 900 nm from the viewpoint of easily controlling the coverage of the ferroelectric particles with the conductor to an appropriate value. The measurement of the average particle diameter is obtained by taking an image with a transmission electron microscope, extracting 50 particles at random, measuring the particle diameter, and arithmetically averaging them. When the particle shape is not spherical, the average value of the major axis and the minor axis can be calculated as the diameter of each particle. The ferroelectric substance according to the present invention preferably is used in an amount of 5 to 40 volume % with respect to the resin.

<Conductive Agent>

As the conductive agent used in the present invention, a known electronic conductive material or ionic conductive material may be used. The conductive material is preferably carbon black, nanocarbon or graphite. The amount of the conductive material used in the present invention is preferably in the range of 1 to 20 mass parts with respect to 100 mass parts of the resin. When it is 20 mass parts or less, the strength of the base material layer and the charge amount of the toner are not decreased, which is preferable. When the content is 1 mass part or more, toner contamination does not occur on the surface of the base material layer. More preferably, it is in the range of 4 to 20 mass parts, and still more preferably in the range of 10 to 20 mass parts.

(Carbon black)

Among the conductive agents, examples of the carbon black include: gas black, acetylene black, oil furnace black, thermal black, channel black, and Ketjen black may be mentioned. Ketjen black, acetylene black and oil furnace black may be cited as effective ones for obtaining a desired conductivity with a smaller amount of mixing. It should be noted that Ketjen black is carbon black of a contactive furnace system. The average primary particle diameter of carbon black is preferably in the range of 10 to 50 nm from the viewpoint of easily controlling the coverage of the ferroelectric particles with the conductor to an appropriate value. The average primary particle diameter may be measured with an apparatus of FPAR-1000 (manufactured by Otsuka Electronics Co., Ltd.) using a photon counting method.

(Nanocarbon)

A typical example of nanocarbon is a carbon nanotube. A carbon nanotube (hereinafter abbreviated as CNT) is a single-layer structure having no defects or a multilayered tube-like material in which graphite hexagonal mesh planes are rounded into a cylindrical shape, or in which they are laminated in a nested manner. The average tube diameter of the CNT contained in the intermediate transfer belt of the present invention is preferably in the range of 10 to 150 nm, and the length of the CNT is preferably in the range of 5 to 12 μm. By setting the diameter and length of the CNTs within the above ranges, appropriate conductivity may be imparted to the intermediate transfer belt, and the ferroelectric particles may be efficiently coated.

This CNT may have a functional group covalently bonded as necessary. For example, by chemically treating CNTs with strong acid, an oxidized CNT with a carboxylic acid group introduced on the surface is produced, and after reacting the oxidized CNT with thionyl chloride, and reacting with alkyl alcohol, a chemically modified CNT that dissolves in organic solvents may be produced. By using such chemically modified CNT, the CNT may be uniformly dispersed in the resin. Further, by applying an electric field from the outside to the CNT dispersed in the resin, the CNT may be oriented in a desired direction, and the dielectric constant of the intermediate transfer belt may be improved.

The average tube diameter and the length may be obtained from a scanning electron microscope (SEM) photograph of the cross section of the intermediate transfer belt, and it is possible to adjust them by cutting (pulverizing) CNT or mixing two or more CNTs.

(Graphite)

As the graphite used in the present invention, either a natural product or a synthetic product may be used. The preferred graphite particle size is difficult to define uniquely due to the fact that the shape of the graphite is scaly and that the shape changes in the dispersion process during the production of the toner carrier. However, it is preferable that the width in the major axis direction (the fracture surface direction) is 100 μm or less. As a measuring method, a sample is directly observed with a microscope and measured.

(Graphene)

Graphene is a sheet-like substance having a planar hexagonal lattice structure of carbon atoms. The graphene sheet is flat graphene and is usually a single layer. The graphene sheet is an artificial material and may be obtained as a flaky powder. For example, it may be produced by a chemical vapor deposition (CVD) method.

The graphene sheet may not be completely a single layer, and may partially include two or more layers. For this reason, the graphene sheet has, for example, less than 2 layers. The size is preferably less than 2 μm and the thickness is preferably 2 nm or less. The graphene sheet laminate preferably has, for example, two or more layers, a size of 5 to 25 μm, and a thickness of 12 nm or less.

A commercial item may be used for a graphene sheet and its laminated body. The number of layers, the size, and the thickness of the graphene sheet and the laminate thereof may be measured by, for example, a transmission electron microscope (TEM).

[Method for Producing Conductor-Coated Particles]

As a method for producing conductor-coated particles in which ferroelectric particles are coated with a conductor, either a dry method or a wet method may be used. It is preferable to produce by a dry method in which a silane coupling agent is dropped or sprayed while stirring and mixing inorganic fine particles.

Specifically, particles in which a ferroelectric substance is coated with a conductor may be produced by the following method. The target ferroelectric particles are charged into a wheel-type kneader with an effective internal volume of 80 L, and mixing and stirring are started at 22 rpm. 110 g of methyltriethoxysilane corresponding to 1.0 mass % with respect to the ferroelectric particles is gradually added to the powder layer while applying a shearing force. After completion of the dropping, mixing and stirring are further continued to obtain particles whose surface is coated with a methylsilane coating. Next, a conductor is gradually added to the particles, and further mixed and stirred while applying a shearing force to obtain particles in which a ferroelectric substance is covered with a conductor. When the dry method is used, ferroelectric particles coated with a conductor can be obtained. However, the dry method is merely an example, and the coating method is not particularly limited. Comparative Example 1 (without coating) described in the examples described later is a case where the dry method was not used, and coated ferroelectric particles were obtained. That is, the difference between Example 1 and Comparative Example 1 is the size of the ferroelectric particles and whether or not to use the dry method. However, it is not limited whether the dry method is used or not, as long as the coated ferroelectric particles can be obtained.

<Average Coverage>

The average coverage of the conductor-coated particles obtained by coating the ferroelectric particles with the conductor is calculated from the cross section of the ferroelectric particles described above. Specifically, a cross section of the ferroelectric particles is photographed with an electron microscope JSM-7401F (manufactured by JEOL Ltd.) at an acceleration voltage of 30 kV at a magnification of 10,000 to 20000 times, and a photographic image is taken. The length of the interface between the ferroelectric substance and the conductor and the circumference of the cross section of the ferroelectric particles can be measured using the photographic image with an image processing analyzer LUZEX AP (manufactured by Nireko Co., Ltd.).

The coverage of the conductor is calculated by the following equation, where A is the length of the interface between the ferroelectric substance and the conductor, and B is the circumferential length of the cross section of the ferroelectric particles. The average coverage is calculated by measuring the coverage of 50 ferroelectric particles and calculating the arithmetic average thereof.

Coverage (%)=(A/B)×100

The average coverage is preferably 10% or more, more preferably 20% or more, and even more preferably in the range of 30 to 90%, from the viewpoint of manifesting the effects of the present invention.

<<Elastic Layer>>

The elastic layer is a layer having desired conductivity and elasticity that may be formed on the outer peripheral surface of the base material as necessary. The elastic layer is made of a rubber material. The thickness of the elastic layer is, for example, 50 to 400 nm. Examples of the rubber material include resins having rubber elasticity such as urethane rubber, chloroprene rubber (CR), and nitrile rubber (NBR). The rubber material preferably contains chloroprene rubber or nitrile butadiene rubber from the viewpoint of controlling the electric resistance of the intermediate transfer belt.

<<Surface Layer>>

According to necessity, the surface layer may be formed on the outer peripheral surface of the base material or the outer peripheral surface of the elastic layer. It is preferable that the surface layer is obtained by a coating film formed with a coating liquid for forming a surface layer containing an active energy ray-curable composition including: metal oxide fine particles (A); a (meth)acrylate monomer (B) having a refractive index nD in the range of 1.6 to 1.8; and a polyfunctional (meth)acrylate (C) other than the (meth) acrylate monomer (B), then by irradiating the coating film with active energy rays and curing. Thereby the durability of the intermediate transfer belt may be improved.

<<Producing Method of Intermediate Transfer Belt>>

Next, a producing method of an intermediate transfer belt made of a base material layer will be described. The following manufacturing method is an example, and any method capable of manufacturing an intermediate transfer belt may be used. To a resin of polyimide varnish "UPIA-AT (U-Varnish-A)" (manufactured by Ube Industries Ltd.) are added 5 volume % of carbon black (MA8: manufactured by Mitsubishi Chemical Corporation), 20 volume % of barium titanate (BT05: manufactured by Sakai Chemical Industry CO., Ltd.), and the above-prepared conductor-coated particles. The mixture is stirred with a mixer to prepare a coating liquid for forming a base material layer.

Next, while rotating the stainless steel cylindrical mold around the cylindrical axis, the dispensing nozzle is moved in the axial direction, and the coating liquid for forming the base material layer is discharged from the nozzle. The coating liquid is applied spirally on the outer peripheral surface of the mold to form a coating film connecting them. Next, most of the solvent is volatilized by heating at 130° C. for 1 hour while rotating the cylindrical mold, and then heated at 350° C. for 1 hour to form an endless belt-like base material layer. The thickness of the base material layer formed by the above method is 65 μm. Then, this base material layer is processed to produce an intermediate transfer belt in which conductor-coated particles are dispersed throughout the resin. The intermediate transfer belt may be produced using only the base material layer produced by the above method, or the intermediate transfer belt may be produced by bonding the elastic layer and the surface layer to the base material layer.

<<Electrophotographic Image Forming Apparatus>>

Next, an electrophotographic image forming apparatus provided with the intermediate transfer belt of the present invention will be described. As indicated in FIG. 2, for example, the electrophotographic image forming apparatus of the present invention (hereinafter also referred to as an image forming apparatus) is a tandem image forming apparatus having photosensitive drums 83Y, 83M, 83C, and 83K as photoreceptors corresponding to four colors of yellow (Y), magenta (M), cyan (C), and black (K) arranged in series in the running direction of the intermediate transfer belt.

Figure 3:
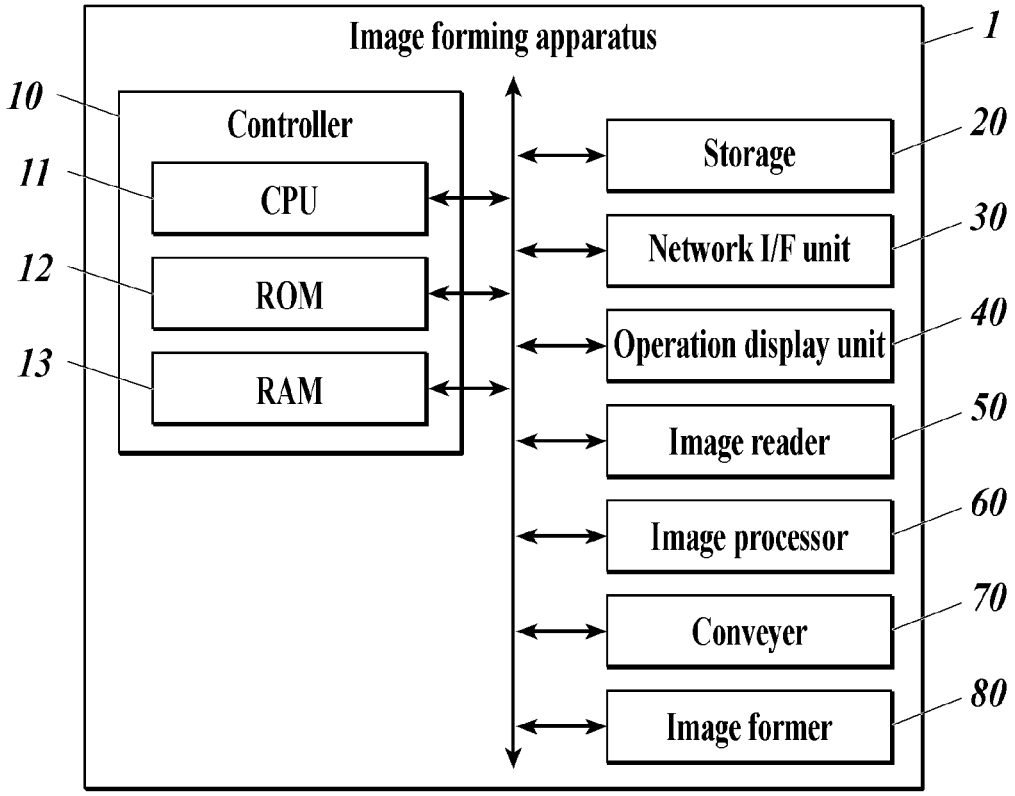
FIG. 3 is a block diagram indicating a configuration of an image forming apparatus of the present invention.

As indicated in FIG. 3, the image forming apparatus 1 has the following units: a controller 10 configured by a CPU (Central Processing Unit) 11, a ROM (Read Only Memory) 12, and a RAM (Random Access Memory) 13; a storage 20 configured by a SSD (Solid State Drive); a network I/F unit configured by a NIC (Network Interface Card) and a modem; a operation display unit 40 configured by a touch panel; an image reader 50 configured by an ADF (Auto Document Feeder) and a scanner; an image processor 60 configured by a RIP (Raster Image Processor); a conveyer 70; and image former 80. The image former 80 that processes the paper transported from the conveyer 70 includes the intermediate transfer belt of the present embodiment.

Figure 2:
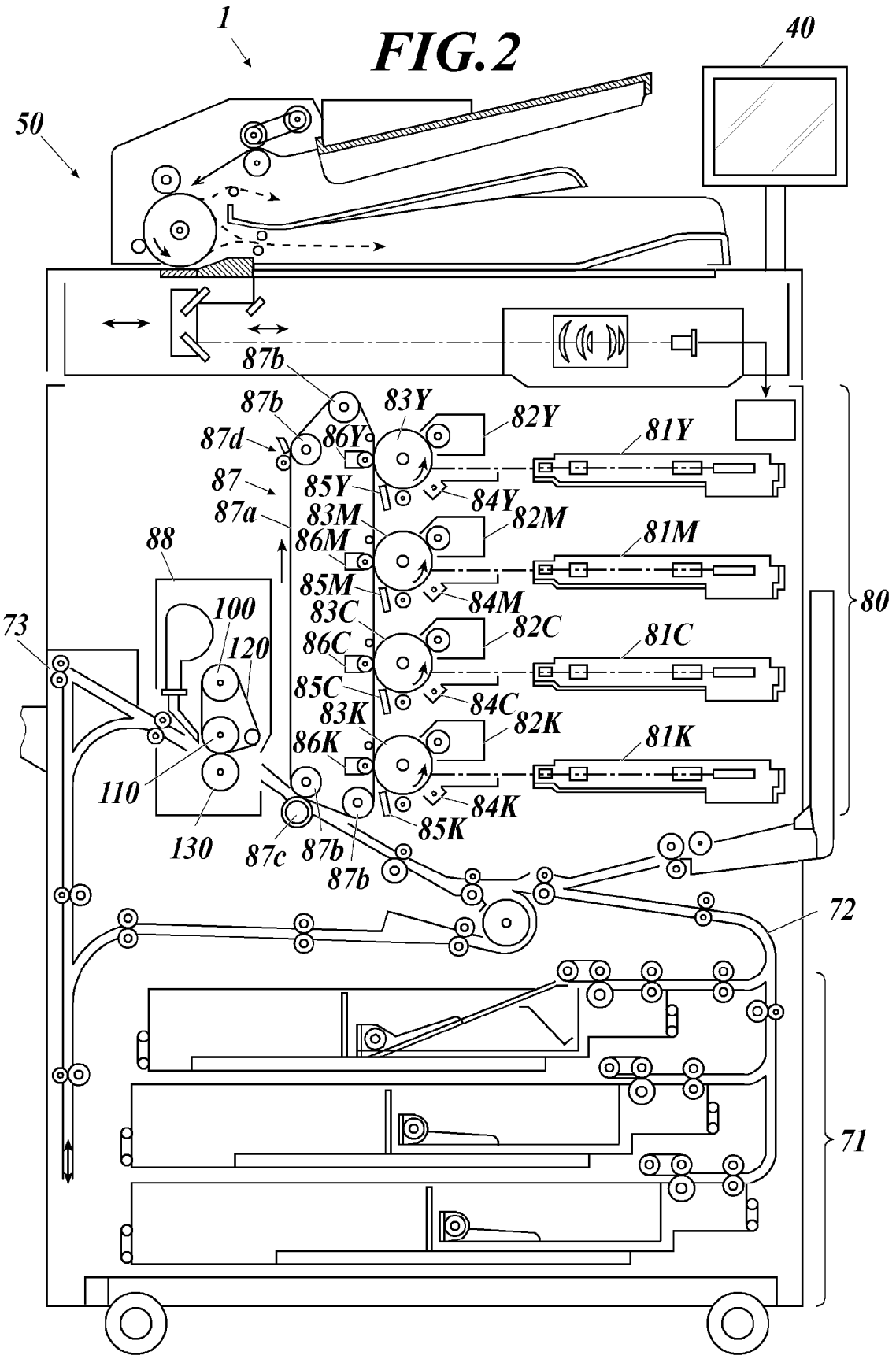
FIG. 2 is a schematic diagram indicating a structure of an image forming apparatus of the present invention.

As indicated in FIG. 2, the conveyer 70 includes a paper feeding device 71, a conveyance mechanism 72, a paper discharge device 73. The sheets of paper stored in the paper feeding device 71 are sent one by one from the top and are conveyed to the image former 80 by the conveyance mechanism 72 having a plurality of conveyance rollers such as registration rollers. At this time, the registration unit provided with the registration rollers corrects the inclination of the fed paper and adjusts the conveyance timing. The paper on which the image is formed by the image former 80 is discharged to a discharge tray outside the apparatus by a discharge device 73 having a discharge roller.

Figure 4:
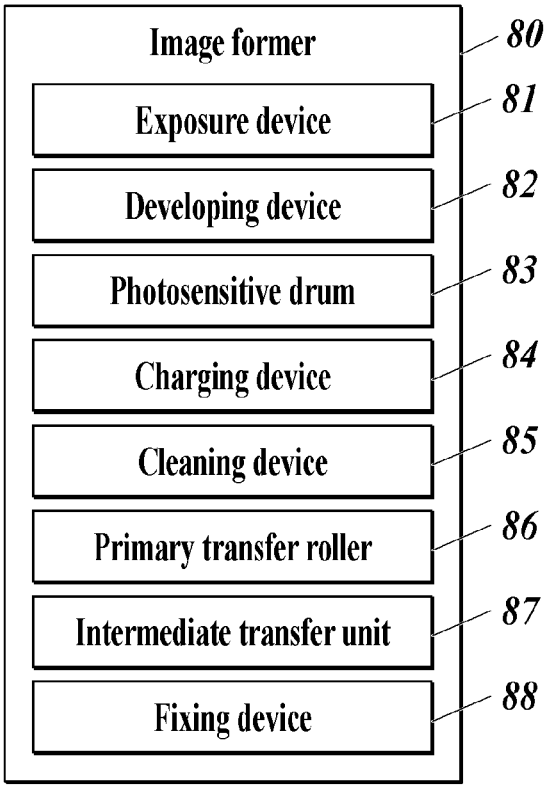
FIG. 4 is a block diagram indicating a configuration of an image forming apparatus of the present invention.

As indicated in FIG. 2 and FIG. 4, the image former 80 is configured by the following: an exposure device 81 (81Y, 81M, 81C, 81K), a developing device 82 (82Y, 82M, 82C, 82K), a photosensitive drum 83 (83Y, 83M, 83C, 83K), charging device 84 (84Y, 84M, 84C, 84K), a cleaning device 85 (85Y, 85M, 85C, 85K), a primary transfer roller 86 (86Y, 86M, 86C, 86K), an intermediate transfer unit 87, a fixing device 88, which are provided corresponding to different color components Y, M, C, and K. Hereinafter, each element will be outlined. In the following description, symbols excluding Y, M, C, and K are used as necessary.

The photosensitive drum 83 of each of the color component Y, M, C, and K is an image carrier formed by an organic photosensitive layer (OPC) in which an overcoat layer as a protective layer is provided on the outer peripheral surface of a cylindrical metal base made of an aluminum material. The photosensitive drum 83 is rotated in the counterclockwise direction in FIG. 2 following the intermediate transfer belt while being grounded.

The charging device 84 for each of the color components Y, M, C, and K is a scorotron type, and is disposed close to the corresponding photosensitive drum 83 in a state where the longitudinal direction thereof is along the rotational axis direction of the photosensitive drum 83. A uniform potential is applied to the surface of the photosensitive drum 83 by corona discharge having the same polarity as the toner.

The exposure device 81 for each of the color components Y, M, C, and K performs scanning in parallel with the rotation axis of the photosensitive drum 83 by, for example, a polygon mirror. An electrostatic latent image is formed by performing image exposure on the surface of the corresponding photosensitive drum 83 that is uniformly charged based on the image data.

The developing device 82 of each of the color components Y, M, C, and K accommodates a two-component developer composed of a toner having a small particle diameter of the corresponding color component and a magnetic material. The developing device conveys the toner to the surface of the photosensitive drum 83, and the electrostatic latent image carried on the photosensitive drum 83 is visualized with the toner.

A primary transfer roller 86 for each of the color components Y, M, C, and K presses the intermediate transfer belt of this embodiment against the photosensitive drum 83, and sequentially superimposes the respective color toner images formed on the corresponding photosensitive drum 83 to primary transfer onto the intermediate transfer belt.

The cleaning device 85 for each of the color components Y, M, C, and K collects residual toner remaining on the corresponding photosensitive drum 83 after the primary transfer. Also, a lubricant application mechanism (not indicated) is provided adjacent to the cleaning device 85 on the downstream side in the rotation direction of the photosensitive drum 83, and the lubricant is applied to the photosensitive surface of the corresponding photosensitive drum 83.

The intermediate transfer unit 87 includes an endless intermediate transfer belt 87*a* to be a transfer target, a support roller 87*b*, a secondary transfer roller 87*c*, and an intermediate transfer cleaning unit 87*d*, and the intermediate transfer belt 87*a* is stretched between a plurality of support rollers 87*b*. The intermediate transfer belt 87*a*, on which the color toner images are primarily transferred by the primary transfer rollers 86Y, 86M, 86C, and 86K, is pressed against the paper by the secondary transfer roller 87*c*. Then, the toner image is secondarily transferred to the paper by the electric field acting on the toner based on the transfer voltage between the intermediate transfer belt 87 a and the secondary transfer roller 87*c*, and the paper is sent to the fixing device 88. The intermediate transfer cleaning unit 87*d* has a belt cleaning blade that is in sliding contact with the surface of the intermediate transfer belt 87*a*. The transfer residual toner remaining on the surface of the intermediate transfer belt 87*a* after the secondary transfer is scraped off and removed by the belt cleaning blade.

The fixing device 88 includes a heating roller 88*a* serving as a heat source, a fixing roller 88*b*, a fixing belt 88*c* and a pressure roller 88*d* that are stretched over the heating roller 88*a* and the fixing roller 88*b*. A pressure roller 88*d* is pressed against the fixing roller 88*b* via the fixing belt 88*c*, and the pressure contact portion forms a nip portion.

The paper on which the toner image is fixed by the fixing device 88 is discharged to a discharge tray outside the apparatus by a discharge device 73 having a discharge roller.

FIG. 2 and FIG. 4 illustrate an example of the image forming apparatus 1 according to the present invention. As long as the intermediate transfer belt 87*a* according to the present invention can be used, the structure and configuration thereof may be changed as appropriate.

EXAMPLES

Hereinafter, the present invention will be specifically described by way of examples, but the present invention is not limited thereto. In addition, although the term "part" or "%" is used in an Example, unless otherwise indicated, it represents "mass part" or "mass %".

[Preparation of Intermediate Transfer Belt]

Using the manufacturing method described above, intermediate transfer belts containing particles in which a ferroelectric material was coated with a conductor were produced (Examples 1 to 8). For comparison, intermediate transfer belts of Comparative Example 1 using ferroelectric particles not coated with a conductor and Comparative Example 2 using no ferroelectric according to the present invention were prepared (Comparative Examples 1 and 2).

Specifically, the intermediate transfer belts of Examples 1 to 8 were prepared as follows. Barium titanate or strontium titanate was used as the ferroelectric substance (ferroelectric filler), and carbon black (CB), carbon nanotube (CNT), graphene, or graphite was used as the conductor (conductive filler). A ferroelectric substance was coated with a conductor, and the particle diameter of the ferroelectric substance, the average particle diameter or average tube diameter of the conductor, and the average coverage of the ferroelectric substance by the conductor are adjusted by controlling the stirring speed and stirring time by changing as indicated in Table 1.

In Comparative Example 1, an intermediate transfer belt was prepared as follows. Barium titanate was used as the ferroelectric substance (ferroelectric filler), carbon black was used as the conductor (conductive filler), and the coating of the ferroelectric substance with the conductor was done to avoid the silane coupling treatment of the ferroelectric substance surface. Thus, the ferroelectric particles had an average particle diameter of 500 nm, and the carbon black has an average particle diameter of 20 nm. In Comparative Example 2, an intermediate transfer belt was prepared as follows. Aluminum titanate not corresponding to the ferroelectric substance according to the present invention was used, and CNT was used as the conductor, covering the aluminum titanate with the conductor, the average tube diameter of CNT was 60 nm, and the average coverage of aluminum titanate by the conductor was adjusted to 10% by controlling the stirring speed and stirring time. The relative permittivity of aluminum titanate at a frequency of 1 MHz is 13 under an environment of a temperature of 23° C. and a humidity of 50% RH.

The following materials were used as described above.

Barium titanate: "BTO5 series" (manufactured by Sakai Chemical Industry Co., Ltd.)

Strontium titanate: "Dielectric powder (no grade classification)" (manufactured by Sakai Chemical Industry Co., Ltd.)

Aluminum titanate: "$Al_2TiO_5$" (manufactured by CeramTec Co., Ltd.)

Carbon black: "MA8" (manufactured by Mitsubishi Chemical Corporation)

CNT: "CNTs40 (N)" (manufactured by SUSN Co., Ltd.)

Graphene: "Ge-EL series" (manufactured by Nippon Graphite Industries Co., Ltd.)

Graphite: "SP Series" (manufactured by Nippon Graphite Industries Co., Ltd.)

The average particle diameter of each ferroelectric particle, the average primary particle diameter of carbon black, and the average tube diameter of CNT were measured by the methods described above.

<Relative Permittivity>

Figure 5:
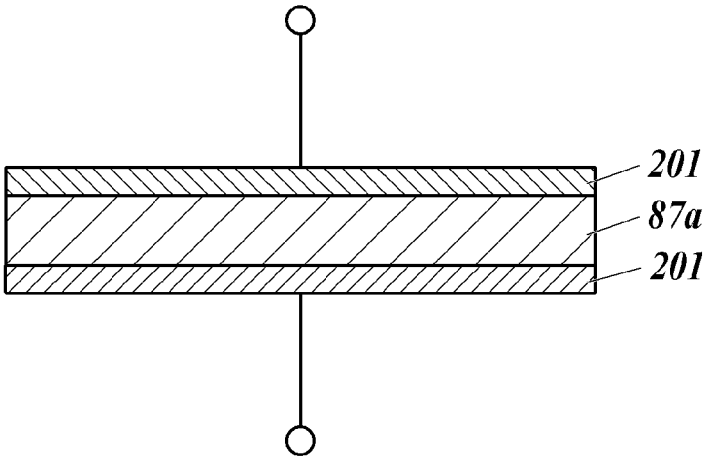
FIG. 5 is a schematic diagram for explaining the dielectric constant measurement method.

The dielectric constant was measured for each of the intermediate transfer belts produced above. As illustrated in FIG. 5, a thin film electrode 201 having a resistance of one digit Ω was formed on both surfaces of the intermediate transfer belt 87*a* by sputtering and cut out with a 10 mmφ mold to prepare a measurement sample. Using an impedance analyzer "1260/1296" (made of Solartron Analytical Co., Ltd.), the dielectric constant (F/m) was measured by the electrode contact method under the conditions of a frequency of 1 MHz and a temperature of 23° C. and a humidity of 50% RH. The relative permittivity was obtained by conversion.

[Evaluation of Black Halftone Image]

The intermediate transfer belts manufactured under the conditions of Examples 1 to 8 and Comparative Examples 1 and 2 were measured and evaluated for transferability and durability. Hereinafter, a specific method for each evaluation will be described. The intermediate transfer belt produced as described above was loaded on an image forming apparatus "KONICA MINOLTA bizhub PRES C11000" (manufactured by Konica Minolta Inc.), and the following evaluation tests were performed using embossed paper (Rezac, 302 g paper) as an image support.

After printing 1 million sheets of images with a printing rate of 20%, an operation was performed to output 1000 sheets of black halftone images on the entire surface of the embossed paper. The obtained visible image was checked visually. The image quality of black halftone images was evaluated according to the following evaluation criteria (transferability evaluation). Further, a bending test (durability evaluation) of the intermediate transfer belt after printing 1 million sheets was performed.

<Transferability Evaluation>

The evaluation criteria for transferability are as follows.

◎: Transfer unevenness is not recognized at all.

○: There is a slight transfer unevenness in the concave part of the embossed paper, but it is recognized that there is no problem in practical use.

Δ There is a slight transfer unevenness on the convex part of the embossed paper, but it is recognized that there is no problem in practical use.

x: It is recognized that there is a problem in practical use due to uneven transfer on the entire paper.

<Durability Evaluation>

After outputting the above black halftone image, a bending test (MIT test) was performed in accordance with JIS P 8115. The number of reciprocations until breakage was measured and evaluated according to the following evaluation criteria. When the number of reciprocations to break is 10,000 or more, it is estimated that there is almost no possibility of breaking during use. When it is less than 1000 times, the belt is likely to break during printing, which is rejected as failing the examination.

◎: 10,000 times or more

○: 1000 times or more and less than 10,000 times x: Less than 1000 times

TABLE I

| | Conductor-coated particles | | | | | | | | |
|---|---|---|---|---|---|---|---|---|---|
| | Dielectric substance | | Conductor | | | | Intermediate transfer belt | | |
| | Kind | Average particle diameter (nm) | Kind | Average primary particle diameter (nm) | Average tube diameter (nm) | Average coverage by the conductor (%) | Relative | Transferability | Durability |
| Example 1 | Barium titanate | 500 | CB | 25 | — | 65 | 25 | ◎ | ◎ |
| Example 2 | Barium titanate | 300 | CNT | — | 40 | 20 | 30 | ◎ | ○ |
| Example 3 | Barium titanate | 500 | CB | 10 | — | 10 | 12 | Δ | ○ |
| Example 4 | Strontium titanate | 300 | CNT | — | 10 | 20 | 15 | ○ | ○ |

TABLE I-continued

| | Conductor-coated particles | | | | | | Intermediate transfer belt | | |
|---|---|---|---|---|---|---|---|---|---|
| | Dielectric substance | | Conductor | | | | | | |
| | Kind | Average particle diameter (nm) | Kind | Average primary particle diameter (nm) | Average tube diameter (nm) | Average coverage by the conductor (%) | Relative | Transferability | Durability |
| Example 5 | Strontium titanate | 900 | CB | 50 | — | 30 | 5 | Δ | ○ |
| Example 6 | Barium titanate | 100 | Graphene | — | — | 80 | 80 | ○ | ○ |
| Example 7 | Barium titanate | 500 | CNT | — | 130 | 40 | 20 | ○ | ◎ |
| Example 8 | Barium titanate | 500 | Graphite | — | — | 25 | 40 | ○ | ○ |
| Compartive Example 1 | Barium titanate | 500 | CB | 20 | — | 0 | 30 | x | x |
| Compartive Example 2 | Aluminum titanate | 500 | CNT | — | 60 | 10 | 1.5 | x | x |

Table I is a table summarizing the production conditions and evaluation results of the intermediate transfer belts of Examples 1 to 8 and Comparative Examples 1 and 2. Examples 1 to 8 are examples of an intermediate transfer belt containing particles in which a ferroelectric is covered with a conductor. The transferability evaluation was Δ, ○, or ◎, and the durability evaluation is ○ or ◎. The transferability evaluation is a level that is recognized to have no problem in practical use, and the durability evaluation is a level at which it is determined that the possibility of the belt breaking during printing is low. Therefore, the intermediate transfer belts of Examples 1 to 8 are revealed to be preferable.

Preferable production conditions of the intermediate transfer belt of the present invention were found as follows: the relative permittivity of the intermediate transfer belt is in the range of 10 to 60; the ferroelectric species is barium titanate or strontium titanate; the average particle diameter of the ferroelectric substance is in the range of 100 to 900 nm; the type of conductor is carbon black having an average primary particle diameter in the range of 10 to 50 nm, CNT having an average tube diameter in the range of 10 to 150 nm, graphene or graphite. The average coverage with the conductor is preferably in the range of 30 to 90%.

The intermediate transfer belt of Comparative Example 1 is not covered with a conductor, and both transferability evaluation and durability evaluation are ranked as "X". In Comparative Example 2, aluminum titanate that does not correspond to the ferroelectric substance according to the present invention is covered with a conductor, and both transferability evaluation and durability evaluation are ranked as "X". Therefore, it has been found that in order to achieve both transferability and durability, it is important that the particles are conductor-coated particles in which a ferroelectric substance is used and the ferroelectric substance is coated with a conductor.

Although the embodiments of the present invention have been described and illustrated in detail, the disclosed embodiments are made for purpose of illustration and example only and not limitation. The scope of the present invention should be interpreted by terms of the appended claims.

What is claimed is:

1. An intermediate transfer belt comprising conductor-coated particles in which ferroelectric particles are coated with a conductor.

2. The intermediate transfer belt described in claim 1 having a relative permittivity at a frequency of 1 MHz in the range of 10 to 60 in an environment of a temperature of 23° C. and a humidity of 50% RH.

3. The intermediate transfer belt described in claim 1, wherein the ferroelectric particles have an average particle diameter in the range of 100 to 900 nm and contain barium titanate or strontium titanate.

4. The intermediate transfer belt described in claim 1, wherein the conductor contains carbon black, nanocarbon, or graphite.

5. The intermediate transfer belt described in claim 1, wherein the conductor contains carbon black having an average primary particle diameter in the range of 10 to 50 nm.

6. The intermediate transfer belt described in claim 1, wherein the conductor contains carbon nanotubes having an average tube diameter in the range of 10 to 150 nm.

7. The intermediate transfer belt described in claim 1, wherein an average coverage of the conductor with respect to the ferroelectric particles is in the range of 30 to 90%.

8. An electrophotographic image forming apparatus provided with the intermediate transfer belt described in claim 1.

* * * * *